US005437003A

United States Patent [19]

Blanco

[11] Patent Number: 5,437,003

[45] Date of Patent: Jul. 25, 1995

[54] IN LINE TANKLESS WATER HEATER WITH UPPER HEATING COMPARTMENT, LOWER WIRING COMPARTMENT, AND MICROSWITCH COMPARTMENT DISPOSED THEREBETWEEN

[75] Inventor: Byron Blanco, Los Angeles, Calif.

[73] Assignee: Hot Aqua Industries, Inc., Culver City, Calif.

[21] Appl. No.: 357,747

[22] Filed: Dec. 16, 1994

[51] Int. Cl.[6] ..... F24H 1/10; H05B 3/78

[52] U.S. Cl. ..... 392/485; 392/492

[58] Field of Search ..... 392/485, 487, 491, 492, 392/494; 122/13.2, 4 A

[56] References Cited

U.S. PATENT DOCUMENTS

| | | | |
|---|---|---|---|
| 1,495,658 | 5/1924 | Wilkinson | 392/485 |
| 1,627,875 | 5/1927 | Underwood | 392/485 |
| 2,544,927 | 3/1951 | Knapp | 122/13.2 |
| 4,762,980 | 8/1988 | Insley | 392/494 |

FOREIGN PATENT DOCUMENTS

| | | | |
|---|---|---|---|
| 1236933 | 6/1971 | United Kingdom | 392/494 |
| 88/00318 | 1/1988 | WIPO | 392/492 |

*Primary Examiner*—John A. Jeffery
*Attorney, Agent, or Firm*—Philip D. Junkins

[57] ABSTRACT

A unitary electric resistance "in line" tankless water heater for interconnection to an electric power supply conduit, a cold water inlet line and a hot water supply line. The heater includes three separate stacked compartment sections of matching circular configuration and formed of molded nonconducting plastic material. A lower field wiring compartment includes in its side wall the mounting port for interconnection of the power supply conduit and encloses a terminal block interconnected to the power leads of the supply conduit. An upper water heating compartment encloses a circular heating coil element and includes in its top cover member a cold water inlet port and a hot water outlet port for interconnection, respectively, to the cold water inlet line and the hot water supply line. An intermediate compartment encloses a microswitch which is electrically interconnected to the power leads via the terminal block in the lower compartment and to the terminals of the heating coil in the upper compartment. A water flow sensing mechanism within the upper compartment, upon sensing water flow between the cold water inlet port and the hot water outlet port, actuates the microswitch within the intermediate compartment thereby energizing the heating coil to produce hot water based upon the flow demand therefor.

12 Claims, 3 Drawing Sheets

IN LINE TANKLESS WATER HEATER WITH UPPER HEATING COMPARTMENT, LOWER WIRING COMPARTMENT, AND MICROSWITCH COMPARTMENT DISPOSED THEREBETWEEN

FIELD OF THE INVENTION

The present invention relates generally to the heating of a fluid media and pertains more particularly to the electrical resistance "in line" heating of water.

BACKGROUND OF THE INVENTION

It has been well established in the patent art and through technical literature that the heating of water has taken two principal system and equipment forms, i.e., continuous flow water heating and reservoir water heating. One classic form of known continuous flow water heating apparatus utilizes an electric resistance coil arranged in an "in line" housing through which cool or normal temperature water is directed on demand to obtain heated water. Known apparatus of this type includes a controller, responsive to a water temperature sensor, whereby alternating current power is switched "on" and "off" to the electrical heating coil of the apparatus based upon demand for heating the water flowing through the apparatus. Reservoir water heating, on the other hand, normally involves the use of one or more heat insulated water storage tanks wherein heated water is withdrawn on demand with heat applied by gas or electric energy to maintain a desired hot water issuance temperature throughout extended non-demand times.

Known electrical resistance "in line" water heating apparatus and systems have deficiencies in several important respects. Thus, such apparatus and systems have frequently employed an electrical resistance heating coil of U-shaped configuration which have commonly required frequent replacement due to burnout of the coil at the U-bend where heat is concentrated during heater operation. Further, such apparatus and systems tend to confuse accurate temperature sensing of the exit temperature of the flowing water. In U.S. Pat. No. 4,762,980, granted to H. Insley, excessive heating of the U-shaped coil at the U-bend area is allegedly avoided by shunting of the coil current in that area. In such patent an encased, thermistor-type temperature sensor (located proximate the U-bend of the heating coil) is connected to an external temperature controller which interconnects with an external switching unit for controlled intermittent energization of the coil.

It is a primary object of the present invention to provide an improved "in line" tankless electric water heater of compact size and ease of installation.

It is a further object of the invention to provide an improved continuous flow electrical resistance water heater which can be easily installed and serviced.

It is a still further object of the invention to provide an improved "in line" tankless electrical resistance water heater wherein the heating coil is of circular configuration and without a U-bend requiring shunting of the coil to avoid excessive heating of the coil in the bend area.

It is yet another object of the invention to provide an improved "in line" tankless electric water heater which is instantaneously responsive to the demand for hot water.

These and other objects and advantages of the present invention will become apparent from the following summary of the invention and detailed description thereof taken in conjunction with the accompanying drawing figures.

SUMMARY OF THE INVENTION

The present invention relates to a fully-encased unitary "in line" tankless electric water heater of cylindrical configuration having top-positioned cold water inlet and hot water outlet ports and a lower mounting port for the interconnection of an electric power supply conduit. The heater unit includes three separate stacked compartment sections of circular configuration (molded of plastic material such as chlorinated polyvinyl chloride) including: a lower field wiring compartment; an intermediate microswitch compartment; and an upper water heating compartment including a circular electric heating element coil.

The lower compartment of the heater unit, defined by an annular side wall of molded plastic material, includes a removable bottom (outer) molded plastic cover plate and is segregated or separated from the intermediate compartment by a separable upper molded plastic cover plate which serves as the lower wall of the intermediate compartment. Both of these cover plates are molded of the same plastic material as used for molding the compartment side walls. The intermediate compartment is defined by a molded annular side wall of the like plastic material. The upper compartment, also formed of the same molded plastic material, is defined by an annular side wall and a unitary molded bottom wall which serves as the upper wall of the intermediate compartment. The separable top cover plate for the heater unit (including the inlet and outlet water ports) is of cast aluminum material and forms the upper wall of the upper water heating compartment.

The lower field wiring compartment includes in its side cylindrical wall the mounting port for interconnection of the power supply conduit to the heater unit. Such compartment encloses a terminal block for interconnection of the power leads from the supply conduit to the interior electrical leads which pass through the upper cover plate of the lower compartment and into the intermediate compartment. The intermediate compartment encloses the set of microswitches (interconnected to the electrical leads from the terminal block of the lower compartment) which control intermittent electrical power input through interconnected electrical leads to the heating coil element of the upper water heating compartment. The microswitches of the intermediate compartment are mounted to the underside of the bottom wall of the upper compartment and are activated, with respect to supplying electric current to the heating element, by a switch actuator interconnected to the water flow sensing mechanism of the upper water heating compartment.

The plastic molded upper water heating compartment is formed with a central post which with the annular side wall of the compartment defines a circular trough within which is positioned the circular heating coil element of the heater unit. The microswitch actuator (plunger rod) passes through central post of the upper compartment and into actuation engagement with the microswitches of the intermediate compartment. Such actuator is connected to a pressure sensitive flexible diaphragm mounted to the top cover plate of the heater unit. This diaphragm is subjected on its upper surface to the pressure of a side stream of cold water from the water inlet port and to heated water on its lower surface thereby flexing and moving the microswitch actuator with respect to hot water demand of the heater unit.

The microswitch actuator or plunger rod which passes through the central post of the bottom wall of the upper compartment is appropriately surrounded by an upward biasing spring and an outer flexible tube whereby the upper compartment is water-sealed with respect to the intermediate compartment. The electrical connect ends of the heating coil element are interconnected to electrical leads of the microswitches through water-tight connector posts leading from the upper compartment to the intermediate compartment thereby further sealing the intermediate compartment from any leakage of water from the upper compartment. The separable cast aluminum top cover plate of the heating unit is sealed with respect to the interfacing upper annular surface of the cylindrical wall of the upper water heating compartment by an O-ring seal.

The foregoing assembly of water heater compartments and enclosed electric heating element and electric control mechanisms results in an improved "in line" tankless electric water heater which is instantaneously responsive to the demand for hot water.

BRIEF DESCRIPTION OF THE DRAWING FIGURES

Figure 1:
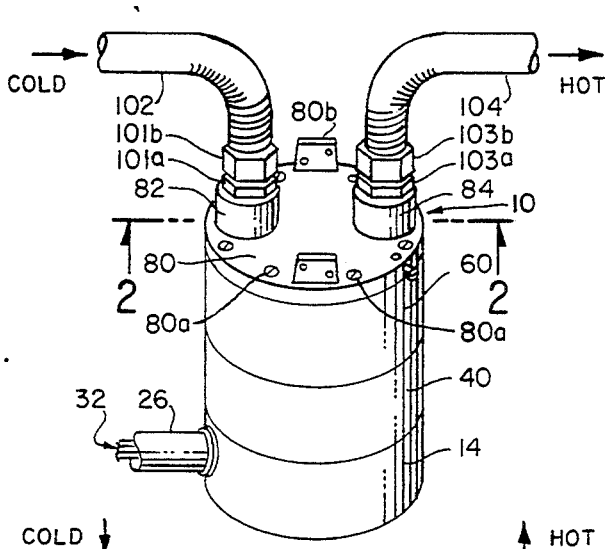
FIG. 1 is a front perspective view of the fully-encased unitary "in line" tankless electric water heater of the present invention showing the cold water inlet and hot water outlet connections and electric power cable connection of the unit.
Figure 2:
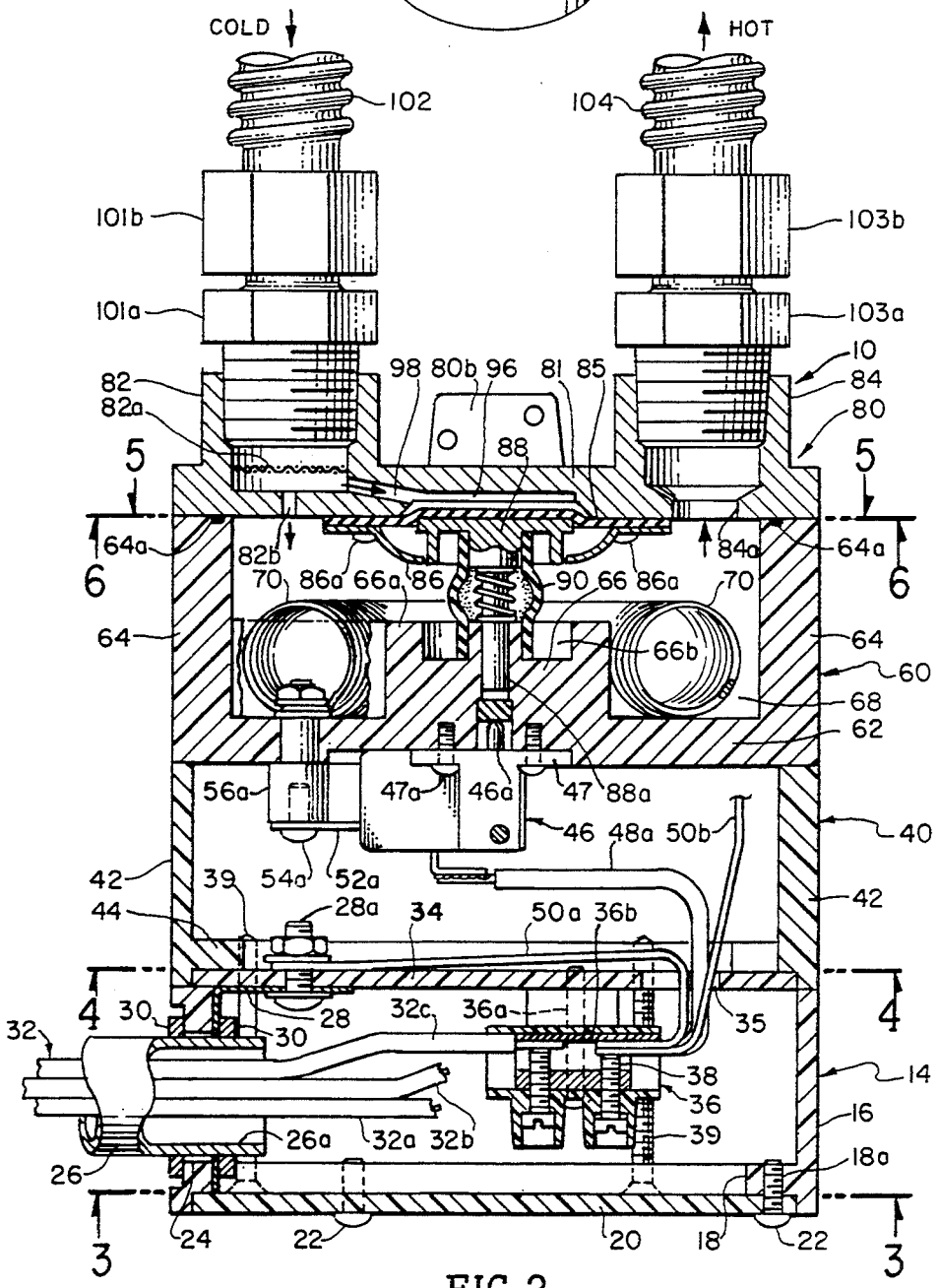
FIG. 2 is a cross sectional view of the water heater unit of FIG. 1 taken on line 2—2 of FIG. 1.
Figure 6:
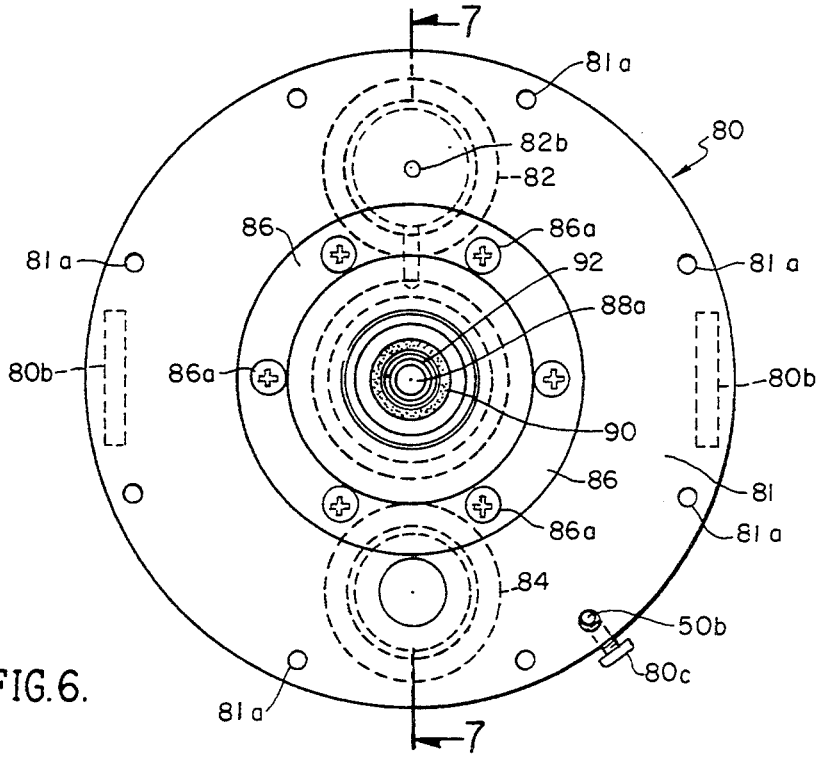
Figure 7:
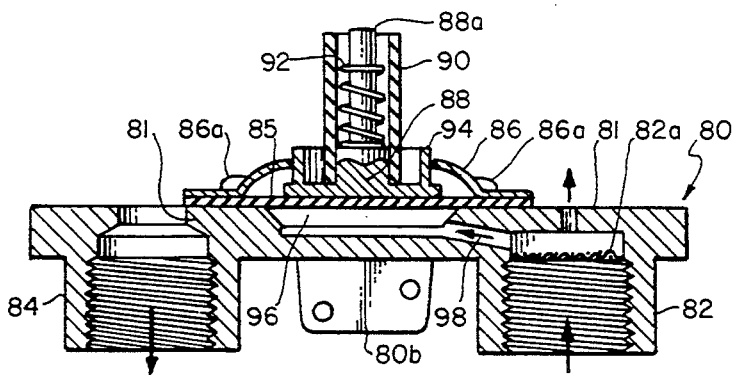

FIG. 6 is an upward view, rotated 90 degrees, of the underside of the top cover plate of the heater unit of FIG. 1 taken on line 6—6 of FIG. 2 and showing the diaphragm cover and plunger of the heater; and FIG. 7 is a cross sectional view of the top cover plate of FIG. 6 taken on line 7—7 of FIG. 6.

DETAILED DESCRIPTION OF THE PREFERRED EMBODIMENT OF THE INVENTION

Referring initially to FIG. 1, there is shown in a front perspective view a fully-encased unitary "in line" tankless electric water heater 10 of compact cylindrical shape in accordance with the present invention. The heater unit includes three separate stacked compartment sections of circular configuration including: a lower field wiring compartment 14; an intermediate microswitch compartment 40; and an upper water heating compartment 60 which contains a circular electric heating coil element. A flexible electric power conduit enclosing a cluster 32 of power leads and ground wire, is attached to the lower compartment 14. A top cover plate 80, affixed in removable sealed relationship to the upper compartment 60, includes cold water inlet port 82 and hot water outlet port 84. A flexible cold water lead-in pipe 102 is connected to the inlet port 82 via pipe couplings **101*a* and 101*b* of known type and a flexible hot water outlet pipe 104 is connected to the outlet port 84 via pipe couplings 103*a* and 103*b* of known type. Top cover plate mounting bolts 80*a* maintain the cover plate 80 in sealed engagement with the upper compartment 60 and brackets 80*b* are affixed to the cover plate for mounting the heater unit 10** in proper position with respect to the plumbing fixtures (not shown) to be serviced by the heater.

The cylindrical side walls of lower field wiring compartment 14 and intermediate microswitch compartment 40 are formed of a suitable molded plastic material such as chlorinated polyvinyl chloride. The cylindrical side wall and integral bottom wall of the upper water heating compartment 60 are also molded of the same plastic material. The top cover plate 80, and integral cold water inlet port 82 and hot water outlet port 84, is formed as an aluminum casting. A removable bottom cover plate and an intermediate plate between the lower compartment and the intermediate compartment (neither plate shown in FIG. 1) are also of molded plastic construction.

Turning now to FIG. 2 there is shown a cross sectional view of the electric "in line" water heater unit 10 of FIG. 1 taken on line 2—2 of FIG. 1. As previously described, the heater is comprised of three separate stacked compartment sections of circular configuration, i.e., lower field wiring compartment 14, intermediate microswitch compartment 40, and upper water heating compartment 60 including a circular electric heating element coil 70.

The lower field wiring compartment 14 of the heater unit 10 is defined by an annular side wall 16 of molded plastic material. The side wall includes an inwardly extending annular flange 18 proximate the lower edge of the wall to which is mounted a bottom (molded plastic) cover plate 20. The circular cover plate 20 is removably affixed to flange 18 by fasteners 22 (machine screws) which are arranged in series about the cover plate and thread into screw holes **18*a* of the flange. The side wall 16 of the lower compartment 14 is provided with a conduit entry port 24 into which is fed the lead-in end of a metallic sheathed electrical power conduit 26. The power conduit 26 is mounted to the side wall within a metallic bracket 28 and held in place by inner and outer mounting nuts 30. The bracket 28 also serves as a ground connection between the conduit sheath and other internal components of the heater. The power conduit 26 includes a bundle of conduit wires 32 including hot wire 32*a*, hot wire 32*b* and ground wire 32*c***.

Figure 3:
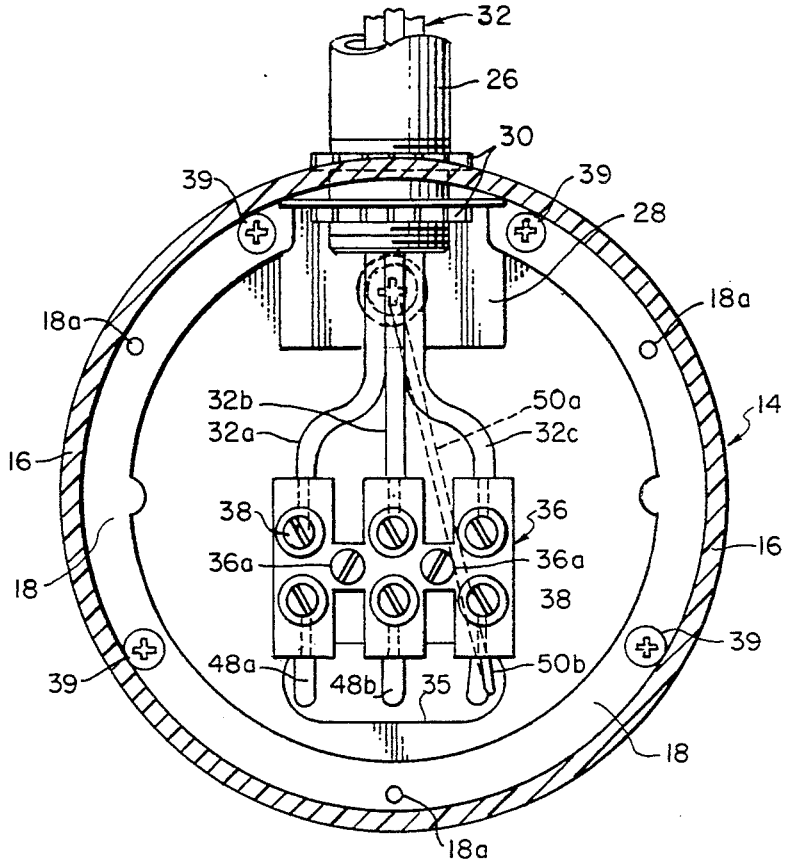
FIG. 3 is a bottom (upward) view, rotated 90 degrees, of the lower section of the heater unit of FIG. 1 (with the bottom cover plate of the unit removed) taken on line 3—3 of FIG. 2 and showing the electrical junction box of the heater.

The lower field wiring compartment 14 is enclosed at its upper end by inner molded plastic (circular) cover plate 34 which includes a wire port 35. Mounted to the cover plate 34, and positioned within the lower compartment 14, is a terminal block 36 which is affixed to plate 34 by several mounting screws **36*a*. A full showing of the terminal block 36 may be seen by reference to FIG. 3 which comprises a bottom (upward) view (rotated 90 degrees) of the lower compartment 14 of heater 10 (with the bottom cover plate 20 of the unit removed) taken on line 3—3 of FIG. 2. Included in the terminal block 36 are a set screws 38 for inter-connecting the power conduit hot wires 32***a* and 32*b* and ground wire 32*c* to internal wires leading to the inter-mediate compartment 40 (through wire port 35 and the microswitch set therein. Connection between the conduit wires and the internal wiring leads is by bus bars 36*b* to which the conduit wires and internal wiring leads are clamped by means of the set screws 38 of the terminal block 36.

The intermediate microswitch compartment 40 of the heater unit 10 is defined by an annular side wall 42 of molded plastic material. The side wall 42 includes an inwardly extending annular flange 44, proximate the lower edge of the compartment wall, to which is mounted the cover plate 34 which separates lower compartment 14 from intermediate compartment 40. The microswitch set (or float switch set) 46, for hot water demand operation of the heater unit 10, is mounted via its mount platform 47 to the underside of the bottom wall 62 of the upper water heating compartment 60. Machine screws 47*a* affix the mount platform 47 to wall 62. A full showing of the microswitch set 46 (in its mounted position on the wall 62) may be seen by reference to FIG. 4 which comprises an upward view (rotated 90 degrees) of the intermediate compartment 40 of heater 10 taken on line 4—4 of FIG. 2.

Figure 4:
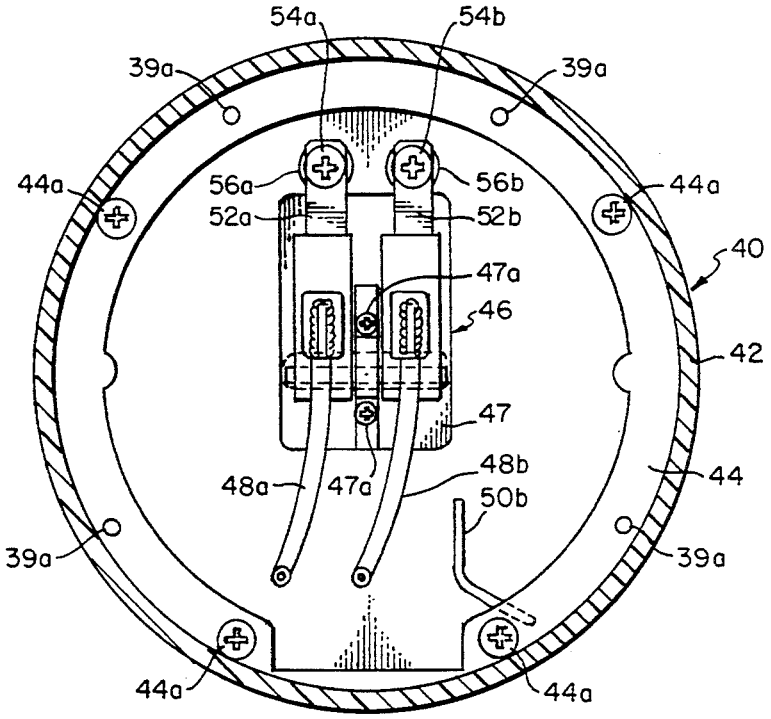
FIG. 4 is an upward view, rotated 90 degrees, of the intermediate section of the heater unit of FIG. 1 taken on line 4—4 of FIG. 2 showing the arrangement of the microswitches of the heater.

The microswitch or float switch 46 (of known design) is interconnected to the terminal block 36 and power conduit hot wires 32*a* and 32*b* by internal wires 48*a* and 48*b* as seen in FIGS. 2 and 4. The ground wire 32*c* of the power conduit is interconnected (via terminal block 36) to ground wires 50*a* and 50*b* with ground wire 50*a* affixed to bracket 28 via bolt 28*a* and with ground wire 50*b* passing upwardly through upper water heating compartment 60 for interconnection to cover plate 80 via set screw 80*c* (see FIG. 6). The microswitch set 46 is in turn interconnected via bus bars 52*a* and 52*b* and terminal bolts 54*a* and 54*b*, respectively, to the circular electric heating coil 70 via coil leads 72*a* and 72*b*, respectively, The coil leads 72*a* and 72*b* are held to terminal bolts 54*a* and 54*b*, respectively, via bolt nuts 58*a* and 58*b*, respectively (see FIGS, 2 and 5). The terminal bolts 54*a* and 54*b* are encapsulated by insulator posts 56*a* and 56*b*, respectively. Such insulator posts also seal off the upper water heating compartment 60 from the intermediate microswitch compartment 40.

The upper water heating compartment 60 of the cylindrical heater 10 is defined by a base wall 62 and upwardly extending annular side wall 64 of integral molded plastic material. The structure of compartment 60 also includes an integrally molded central post section 66 which with the annular side wall 64 defines a circular water circulation trough 68 within which is positioned the circular electrical heating coil element 70 of the heater unit 10. The central post section 66 of the structure of the water heating compartment 60 also includes an annular ridge 66*a* and center post 66*d* which define annular groove 66*b*. The center post 66*d* includes a central bore 66*e* through which a microswitch actuator (control plunger rod positioned by a pressure sensitive flexible diaphragm carried by the top cover plate 80 as described hereinafter) which moves downwardly when water flows through the heater to initiate the operation of the microswitch set 46 and thereby energize the heating coil. Leading from the central post section 66 to the inside of side wall 64 is a molded-in partition 66*c* which isolates the heating coil terminal bolts 54*a* and 54*b* and heating coil leads 72*a* and 72*b* from one-another.

The separable top cover plate 80 of the heater unit 10, as previously indicated, comprises an aluminum casting which includes a top circular wall 81, a cold water inlet port 82 and a hot water outlet port 84. A changeable filter screen 82*a* is mounted in the inlet port 82 to inhibit the introduction of water supply debris into the upper water heating compartment 60. Centrally affixed to the underside of wall 81 of the cover plate 80 is a circular, pressure sensitive, flexible elastomeric diaphragm 85. Such diaphragm is protected in its peripheral rim area by a copper diaphragm cover 86 with the cover 86 and diaphragm 85 mutually affixed at their edge areas to the wall 81 by machine screws 86*a*.

Interfacing the underside of the diaphragm 85 is a brass diaphragm plunger unit 88 from which there extends downwardly through the bore 66*e* of the center post 66*d* of the upper compartment 60 a plunger rod or stem 88*a*. The plunger rod or stem 88*a* acts as the actuator for the microswitches in the intermediate compartment 40 of the heater 10. As shown in FIGS. 2 and 7 the diaphragm plunger unit 88 bears a flexible seal tube 90 (of silicone rubber material) which extends to, and is in sealing engagement with, the center post 66*d* of the central section 66 of the upper compartment 60. This seal tube surrounds the plunger rod or stem 88*a* and protects the intermediate microswitch compartment 40 from water leakage that otherwise might occur around the stem 88*a* within the bore 66*e* which extends through the bottom wall 62 of the water heater compartment 60. A spring member 92 surrounds the stem 88*a*, within the tube 90 and biases the diaphragm plunger unit 88 upwardly into firm engagement with diaphragm 85 when there is no flow of water through the heater. In its upwardly biased position, the rod or stem portion 88*a* of the plunger unit 88 is positioned out of actuation contact with the switch plunger 46*a* whereby the heating coil 70 is not energized. The plunger unit 88 is provided with an annular rim wall 94 which moves without interference through the central opening of the diaphragm cover 86.

The top side of the diaphragm 85 interfaces with a central water chamber 96 formed on the underside of the top cover plate 80. The water chamber 96 is interconnected to the cold water inlet port 82 via a side stream channel 98. Thus, when water flow is initiated through the "in line" heater of the invention, cold inlet water from inlet port 82 enters the channel 98 and within chamber 96 applies pressure to the diaphragm 85 thereby forcing the plunger unit 88 and its stem portion 88*a* downwardly to actuate the microswitch set 46 within the intermediate compartment 40 and energize the electric heating coil 70 within water heating compartment 60. At the same time cold water entering the heater 10 through inlet port 82 passes through cold water supply orifice 82*b*, enters the water heating compartment 60 for passage over energized heating coil 70, and passes out of the heater unit 10 through outlet orifice 84*a* and outlet port 84 as heated water.

Assembly of the electrical resistance "in line" tankless water heater of the present invention proceeds initially with the mounting of the top cover plate 80 (including the internal diaphragm 85, diaphragm plunger unit 88 and plunger biasing spring 92) onto the upper water heating compartment 60 as shown in FIG. 2. The water heating compartment will have previously received therein the circular electric resistance heating coil 70 with its lead wires 72*a* and 72*b* secured to terminal bolts 54*a* and 54*b*. Further, the base or bottom wall 62 of the water heating compartment 60 will have had the microswitch set 46 mounted to the underside thereof with its bus bars 52*a* and 52*b* affixed to terminal bolts 54*a* and 54*b* as shown in FIGS. 2 and 4.

Figure 5:
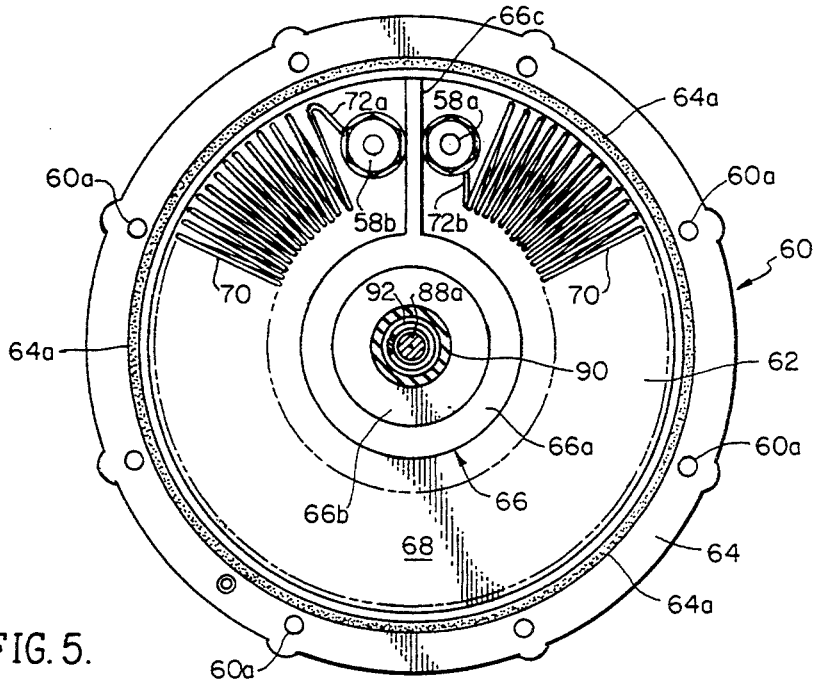
FIG. 5 is a downward view, rotated 90 degrees, of the upper section of the heater unit of FIG. 1 taken on line 5—5 of FIG. 2 and showing the circular heating element coil of the heater.

In mounting the top cover plate 80 to the circular side wall 64 of the water heating compartment care must be taken to align the flexible seal tube 90 so that it properly seats on plunger 88 at its upper end and on center post 66*d* of center section 66 of heating compartment base 62 at its lower end. As previously indicated seal tube 90 provides the necessary water seal with respect to plunger rod 88*a* which interacts with the switch plunger 46*a* of microswitch 46 upon water flow movement within compartment 60 causing the downward movement of diaphragm 85 and plunger unit 88 against the upward bias thereof by spring 92. Further, in mounting the cover plate 80 to the side wall 64 of compartment 60, the O-ring seal 64*a* must be in place in an appropriate annular groove on the upper surface of the side wall 64. Bolting of the cover plate 80 to the side wall 64 is accomplished via mounting bolts 80*a* which extend through the annular ring of bolt holes 81*a* as shown in the FIG. 6 underside view of the cover plate and which thread into the annular ring of threaded holes 60*a* of the circular side wall 64 as shown in FIG. 5.

Following assembly of the cover plate 80 to the water heating compartment 60, the circular side wall 42 of the microswitch compartment 40 is bolted to underside of the bottom wall of compartment 60 via mounting bolts 44*a* (see FIG. 4) which extend through the lower annular flange 44 of compartment 40 and are threaded into a ring of mounting holes (not shown) in the bottom wall 62 of the upper water heating compartment 60. Thereafter, with electrical connection of microswitch wires 48*a* and 48*b* and ground wires 50*a* and 50*b* appropriately made to the terminal block 36 the cover plate 34 (with terminal block 36 mounted to the underside thereof) is mounted to the lower annular flange 44 of compartment 40 via mounting bolts (not shown) which extend through the peripheral area of plate 34 and thread into mount holes 39*a* (see FIG. 4) of flange 44.

The lower field wiring compartment 14 is mounted to intermediate compartment 40 via mounting bolts 39 (see FIGS. 2 and 3) which extend through the lower annular flange 18 of compartment 14, a ring of bolt holes in the cover plate 34 and thread into the ring of holes 39*a* in the lower flange 44 of compartment 40 (see FIG. 4). Thereafter, with the power supply conduit 26 appropriately secured in entry port 24 of the circular wall 16 of the lower field wiring compartment 14 and with hot wires 32*a* and 32*b* and ground wire 32*c* of such conduit affixed to terminal block 36 (see FIGS. 2 and 3), the bottom cover plate 20 is affixed to the lower annular flange 18 of compartment 14 via machine screws 22 thereby closing the heater unit 10.

Through the foregoing described heater structure, and assembly procedures, there is provided an improved "in line" tankless electric water heater which is of compact size, is safe with respect to its electrical power input, has all of its metallic components appropriately grounded to avoid electrical shocks, and is instantaneously responsive to the demand for hot water. The molded plastic structure of compartments 14, 40 and 60 and cover plates 20 and 34 provides electrical insulation protection of the heater and the upper water heating compartment 60 is designed to maintain and isolate water and water flow from the electrical components contained in intermediate microswitch compartment 40 and lower field wiring compartment 14.

The heater of the invention, when mounted in the water line leading to a hot water faucet, heats the water instantly, on demand, as it passes therethrough. The more open the faucet, the greater the quantity of water passing through the heater and the water that is delivered is cooled down. As the faucet is closed down the water becomes warmer. The microswitch of the heater will not activate the heating coil if the amount of water flow is limited. The heater may be energized by alternating electric current power at voltage levels of 120, 208 and 240. The performance of selected heater models is set forth below:

| Model | Gal Per Min./Temp. Rise. Deg. F. | | | | | Voltage | |
|---|---|---|---|---|---|---|---|
| No. | 0.5 GPM | 1.0 GPM | 1.5 GPM | 2.0 GPM | Watts | A/C | Amps |
| A | 32 | 16 | 12 | 8 | 2400 | 120 | 20 |
| B | 44 | 22 | 17 | 11 | 3200 | 120 | 27 |
| C | 46 | 23 | 17 | 12 | 3600 | 240 | 15 |
| D | 82 | 41 | 30 | 20 | 5900 | 240 | 25 |
| E | 45 | 23 | 17 | 12 | 3500 | 208 | 17 |
| F | 82 | 41 | 31 | 20 | 6000 | 208 | 29 |

While the present invention has been shown in the drawing figures and described above with respect to a preferred embodiment, it will be apparent to those skilled in the art that changes in form and detail may be made therein without departing from the spirit and scope of the invention as set forth in the following claims.

What I claim is:

1. A unitary electric resistance "in line" tankless water heater for interconnection to an electric power supply conduit, a cold water inlet line and a hot water supply line, said heater comprised of:

a) a lower field wiring compartment having a port for receiving said electric power supply conduit, said compartment enclosing a terminal block positioned therein for interconnection to power supply leads of said power supply conduit;

b) an upper water heating compartment having a central post section, said compartment containing a circular electric coil heating element positioned around said post section and having separated coil-end terminals, and said compartment having a cold water inlet port for interconnection to said cold water inlet line and having a hot water outlet port for interconnection to said hot water supply line;

c) an intermediate compartment enclosing a microswitch with electric power input leads interconnected through said terminal block to said power supply leads and with power output leads interconnected to said coil-end terminals; and d) heater control means within the upper water heating compartment responsive to the entry flow of cold water from said cold water inlet port and to the exit flow of heated water through said outlet port, said control means mechanically interactive with said miroswitch to electrically energize said heating element when water flows within said upper compartment.

2. The "in line" tankless water heater as claimed in claim 1 wherein the lower field wiring compartment is defined by a molded plastic cylindrical side wall, the upper water heating compartment is defined by a molded plastic cylindrical side wall and an integral bottom wall from which there projects upwardly said central post section, and the intermediate compartment is defined by a molded plastic cylindrical side wall, the side walls of said compartments having like outside diameters.

3. The "in line" tankless water heater as claimed in claim 2 wherein the cylindrical side wall of said upper water heating compartment and the central post section of said compartment together define an annular trough within which is positioned said circular electric coil heating element.

4. The "in line" tankless water heater as claimed in claim 2 wherein the lower field wiring compartment is further defined by a removable bottom cover plate and a removable upper cover plate, the upper water heating compartment is further defined by a removable top cover plate which includes said cold water inlet port and said hot water outlet port, and the intermediate compartment is further defined by said upper cover plate of said lower compartment and by said bottom wall of said upper water heating compartment.

5. The "in line" tankless water heater as claimed in claim 4 wherein the terminal block within the lower field wiring compartment is mounted to the removable upper cover plate of said lower compartment, the microswitch within the intermediate compartment is mounted to the underside of the bottom wall of said water heating compartment, and the heater control means within the upper water heating compartment includes a flexible elastomeric diaphragm affixed to said top cover plate and interfacing plunger unit which interacts with a plunger rod which movably passes through the bottom wall of said water heating compartment to actuate said microswitch when cold water flowing from said cold water inlet port acts upon the upper surface of said diaphragm.

6. A unitary electric resistance "in line" tankless water heater for interconnection to an electric power supply conduit, a cold water inlet line and a hot water supply line, said heater comprised of:

a) a lower field wiring compartment defined by a cylindrical side wall, a removable bottom cover plate and a removable upper cover plate, said lower compartment having a port in said side wall for receiving said electric power supply conduit, and said lower compartment enclosing a terminal block mounted to the underside of said upper cover plate and positioned within said compartment for interconnection to power supply leads of said power supply conduit;

b) an upper water heating compartment defined by a cylindrical side wall and an integral bottom wall from which there projects inwardly and upwardly a central post section, said upper compartment containing a circular electric coil heating element positioned around said post section in the trough space formed between said post section and said side wall and having separated coil-end terminals, and said upper compartment having a removable top cover plate including a cold water inlet port for interconnection to said cold water inlet line and including a hot water outlet port for interconnection to said hot water supply line;

c) an intermediate compartment defined by a cylindrical side wall, the removable upper cover plate of said lower compartment, and said bottom wall of said upper compartment, said intermediate compartment enclosing a microswitch with electric power input leads interconnected through said terminal block to said power supply leads and with electric power output leads interconnected to said coil-end terminals; and d) heater control means within said upper compartment responsive to the entry flow of cold water from said cold water inlet line and cold water inlet port and to the exit flow of heated water through said outlet port and hot water supply line, said control means mechanically interactive with said microswitch to electrically energize said heating element when water flows within said upper compartment.

7. The "in line" tankless water heater as claimed in claim 6 wherein the circular side wall of said lower compartment, the circular side wall, bottom wall and central post section of said upper compartment, the circular side wall of said intermediate compartment, and the removable bottom cover plate and removable upper cover plate of said lower compartment are fabricated of non-conducting molded plastic material.

8. The "in line" tankless water heater as claimed in claim 7 wherein said upper compartment includes a partition of non-conducting molded plastic material which extends upwardly from the bottom wall between said cylindrical side wall and said central post section and separates the coil-end terminals of said circular electric coil heating element.

9. The "in line" tankless water heater as claimed in claim 6 wherein the heater control means within the upper water heating compartment includes a flexible diaphragm affixed to said top cover plate and interfacing plunger unit which interacts with a plunger rod which movably passes through the central post section and bottom wall of said water heating compartment to actuate said microswitch when cold water flowing from said cold water inlet port acts upon the upper surface of said diaphragm.

10. The "in line" tankless water heater as claimed in claim 9 wherein the plunger rod which movably passes through the central post section and bottom wall of said water heating compartment is surrounded by spring means which extends between said interfacing plunger unit and said central post section to apply a biasing force on said plunger unit whereby when there is no water flow within said water heating compartment said plunger rod does not actuate said microswitch.

11. The "in line" tankless water heater as claimed in claim 10 wherein said plunger rod and said spring means are surrounded by a flexible cylindrical tube extending from said interfacing plunger unit to said central post section in water sealing engagement therewith.

12. The "in line" tankless water heater as claimed in claim 9 wherein the top cover plate of upper water heating compartment includes on the underside thereof a central water chamber which interfaces the flexible diaphragm of said heater control means and is connected to the cold water inlet port by a side stream channel whereby when cold water flows through said water inlet port the pressure of the water flow therein is transmitted by the water in said side channel and said central water chamber and applied to said diaphragm to actuate said microswitch.

* * * * *